United States Patent [19]

Meyer et al.

[11] Patent Number: 4,922,997

[45] Date of Patent: May 8, 1990

[54] FRICTION DRIVE TOROIDAL REGENERATOR

[75] Inventors: Robert H. Meyer, West Bloomfield; Ronald C. Pampreen, Bloomfield Hills, both of Mich.; Kenneth W. Sawyer, Escondido, Calif.

[73] Assignee: Williams International Corporation, Walled Lake, Mich.

[21] Appl. No.: 165,083

[22] Filed: Mar. 7, 1988

[51] Int. Cl.[5] ..... F28D 19/00

[52] U.S. Cl. ..... 165/8; 165/9

[58] Field of Search ..... 165/8, 10, 9

[56] References Cited

U.S. PATENT DOCUMENTS 3,177,928 4/1965 Tumavicus et al. ..... 165/8

3,456,518 7/1969 Topouzian ..... 165/8

FOREIGN PATENT DOCUMENTS 543093 2/1942 United Kingdom ..... 165/8

*Primary Examiner*—Albert W. Davis, Jr.

*Attorney, Agent, or Firm*—Lyman R. Lyon

[57] ABSTRACT

A rotatable regenerator of toroidal configuration is frictionally driven by a single roller disposed internally of the toroid.

4 Claims, 1 Drawing Sheet

FRICTION DRIVE TOROIDAL REGENERATOR

BACKGROUND OF THE INVENTION

The present invention relates generally to a rotary heat exchanger intended to be used in, for example, a gas turbine.

It is known to make rotary heat exchangers in the form of a disc of porous ceramic material mounted within a metallic rim having outer teeth that mesh with one or more driving pinions. In practice, difficulty is encountered in sealing such discs and in ensuring the integrity of the connection between the ceramic disc and the metallic rim due to the difference between the coefficients of expansion of ceramic and steel. Moreover, known drive techniques, namely, cutting of gear teeth into the solid outer ring of the core and driving the ring with a metal spur gear do not provide both support and drive.

SUMMARY OF THE INVENTION

A toroidal regenerator utilizing a friction drive in accordance with the instant invention is designed to solve the aforesaid problem. The regenerator is designed as a component of an advanced gas turbine engine with a cycle pressure ratio of approximately 9:1, turbine inlet temperature of 1371° C., and producing 396 kW. The regenerator contributes to a reduction in fuel consumption, weight, and volume. The regenerator comprises a porous ceramic core made of calendered aluminum silicate sandwiched between solid lithium aluminum silicate structural rings. Both the core and rings exhibit extremely low thermal stress under the high termal gradient typical of high temperature heat exchangers. "Piston ring" seals are disposed about the toroid which may be rubbing seals made of thin sheet metal with a nickel oxide calcium fluoride coating, or nonrubbing seals made from low expansion ceramic material.

In accordance with the present invention, the toroid is driven by a single metal friction drive roller, disposed internally of the toroid, thereby minimizing the number of parts and complexity as compared to known regenerators. The toroidal regenerator exhibits improved performance relative to disc regenerators, namely, reduced high pressure seal length, simplified seal geometry, and simplified drive arrangement.

The drive arrangement of the toroidal regenerator of the instant invention eliminates the use of a metal ring gear which is subject to expansion relative to the toroid.

The toroid is exposed to a large unbalanced pressure-induced load in the plane of each high pressure seal. Within the passages of the ceramic core, the pressure gradient at the seal and the reaction to this pressure load approaches 21.615 kN at maximum compressor discharge pressure. Since the expected coefficient of friction between the drive roller and the toroid is 0.3, a traction force of up to 7.205 kN is developed in the smooth interface between the toroid and the drive roller. Accordingly, it is feasible to use the drive roller as both a regenerator support and as a friction drive mechanism, with no need for heretofore utilized gears.

Use of a single saddle-shaped drive roller resulted from analysis which shows that, because of the saddle shape of the roller, and because of placement of the roller on the inside diameter of the toroid, relatively low bearing contact stress and minimum sliding contact is exhibited. Based upon the above considerations, a single friction drive roller and support is utilized which is located internally of the toroid and sized as large as possible while accommodating the space for the necessary piston ring seals.

BRIEF DESCRIPTION OF THE DRAWINGS

One embodiment of a friction drive for a rotary regenerator according to the invention will now be more particularly described with reference to the accompanying drawings in which.

DETAILED DESCRIPTION OF THE PREFERRED EMBODIMENT OF THE INVENTION

Figure 1:
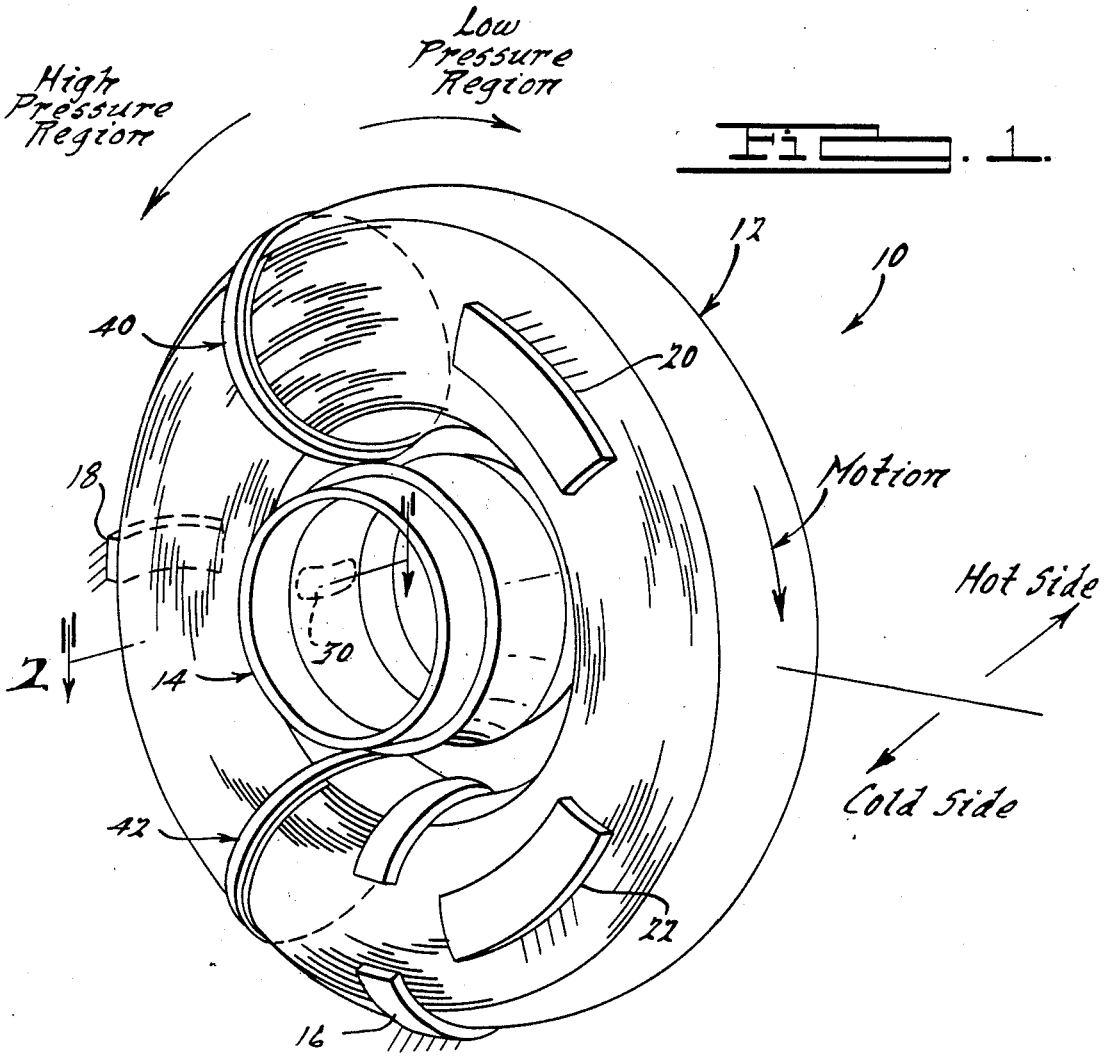
FIG. 1 is a diagrammatic perspective view of the regenerator and drive system therefor.

Referring to the drawing, a rotary regenerator 10 comprises a toroid 12 made of, for example, a glass-ceramic or other low thermal expansion material. The toroid 12 is supported and driven by a single large saddle-shaped metal roller 14. Four fixed bumpers 16, 18, 20 and 22 are used to aid in positioning the toroid 12 and carry shock and gravitational loads. A relatively large contact patch 30 exists between the drive roller 14 and the toroid 12 that minimizes unit pressure and slip therebetween. For example, a drive roller of 171 mm diameter exhibits a contact patch of 3×81 mm. Use of the friction drive results in a large inner ring to core interface, eliminates the drive ring gear, whose attachment has been a persistent problem in disc regenerators, and provides support at a point conducive to minimum relative motion at the high pressure seal, enabling small seal travel forces.

Figure 2:
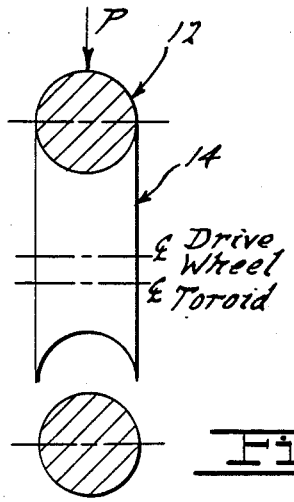
FIG. 2 is a section through the rotary regenerator of FIG. 1 taken on line 2—2 of FIG. 1.

As seen in FIG. 1, seals 40 and 42 are disposed above and below the axis of rotation of the toroid 12. As seen in FIG. 2, the drive roller 14 engages the toroid 12 midway between the seals 40 and 42 so as to improve a horizontal bias thereon.

Pressure drop across circumferentially spaced pressure seals 40 and 42 at maximum power is 840 kPa. This pressure is applied at each of the seals 40 and 42, 90-degrees apart on the toroid's 15.2 cm diameter cross section, resulting in a net force of 21.613 kN at maximum power. This force is transmitted at a right angle to the axis of rotation of the drive roller 14. Thus, only a relatively small shear force is necessary to drive the toroid 12 with the drive roller 14. It is to be noted that the interface between the toroid 12 and the drive roller 14 is self-cleaning due to the upward motion of the roller 14 so that any loose particles will naturally fall away from the interface. The high pressure seals 40 and 42 will constantly wipe the toroid surface.

The rigidly mounted single drive roller 14 controls the location of only one point on the toroid accurately. Location of roller 14 interface is approximately halfway between the two high pressure seals to minimize relative thermal and pressure deflections. The rigid carbon bumper 16 positions the toroid 12 vertically and laterally and supports normal operating loads including shock. Nonoperating shock loads are taken by the large rigid bumper 18. Reaction loads due to exhaust gas pressure drop are taken by the bumpers 20 and 22. The bumpers 16, 18, 20 and 22 are provided with arcuate surfaces that conform to the contour of the toroid 12. Under maximum power conditions, the exhaust gas pressure bumpers 20 and 22 carry approximately 580N and are exposed to a maximum temperature of 480° C., enabling the use of graphite with a coefficient of friction of 0.07. The face area for each bumper is 450 $cm^2$, blocking 7.7 percent of the face area.

Rolling contact stress between the toroid 12 and the drive roller 14 is critical to the operation of the toroidal regenerator 10. This interface is similar to the elliptical contact between a ball bearing race and the ball, and so classical techniques of analysis can be applied. One analytical procedure for resolution of this compressive stress is shown in "Formulas for Stress and Strain" by Roark & Young, fifth edition, page 518, Case No. 4. A second source is "Analysis of Stress and Deflections" by A. B. Jones, published by New Departure, 1946, Volume 1, pages 12–13 and Volume 2, Charts 8 and 23.

This analysis resolves the patch size, the average stress, and the peak stress on the contact patch. It is to be noted that since the toroid 12 is supported and driven by the single large saddle-shaped metal roller 14, the pressure drop across the high pressure seals is transmitted normal to the contact patch. Thus, the drive roller 14 must be of relatively large diameter with transverse curvature to minimize the Hertzian contact stress between itself and the toroid 12.

From the foregoing it is apparent that friction drive and accurate positioning of the toroid 12 is achieved by the use of a single drive roller in combination with a plurality of bumpers 16, 18, 20 and 22. Unit loading and seal movement is minimized which permits the use of small, lightly loaded and therefore responsive seal elements. Location of the drive roller to toroid interface 30 halfway between the two high pressure seals 40 and 42 minimizes relative thermal and pressure deflection.

While the preferred embodiment of the invention has been disclosed, it should be appreciated that the invention is susceptible of modification without departing from the scope of the following claims.

We claim:

1. In combination with a rotatable toroidal regenerator, a single drive roller having an outside diameter smaller that an inside diameter of said toroid said drive roller being disposed internally of said toroid and frictionally engaged therewith at a single contact, said drive roller being rotatable about an axis extending parallel to and spaced from the axis of rotation of said toroid, said driver roller effecting rotation of said toroid upon rotation of said drive roller.

2. The regenerator of claim 1 wherein said contact patch between said drive roller and toroid is approximately at a midpoint vertically of said toroid.

3. The regenerator of claim 1 including a pair of circumferentially spaced seals disposed about said toroid, the point of engagement between said drive roller and toroid being equally spaced from said seals.

4. The regenerator of claim 1 including a plurality of fixed bumpers for positioning said toroid, one of said bumpers being disposed radially outwardly and on the opposite side of said toroid from the point of engagement thereof by said drive roller.

* * * * *